US008843015B2

(12) United States Patent
Utsunomiya et al.

(10) Patent No.: US 8,843,015 B2
(45) Date of Patent: Sep. 23, 2014

(54) IMAGING DEVICE, IMAGE FORMING APPARATUS, AND PROCESS CARTRIDGE

(75) Inventors: Kohichi Utsunomiya, Kanagawa (JP); Kiyonori Tsuda, Kanagawa (JP); Hideo Yoshizawa, Kanagawa (JP); Takuzi Yoneda, Tokyo (JP); Emi Kita, Kanagawa (JP); Yutaka Takahashi, Kanagawa (JP); Yuki Oshikawa, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 268 days.

(21) Appl. No.: 13/402,214

(22) Filed: Feb. 22, 2012

(65) Prior Publication Data

US 2012/0237249 A1 Sep. 20, 2012

(30) Foreign Application Priority Data

Mar. 18, 2011 (JP) ..... 2011-060797

(51) Int. Cl.
*G03G 21/20* (2006.01)
*G03G 15/08* (2006.01)

(52) U.S. Cl.
CPC ..... *G03G 15/0898* (2013.01); *G03G 21/206* (2013.01)
USPC ..... 399/92; 399/25; 399/11; 399/119; 399/222

(58) Field of Classification Search
USPC ..... 399/25, 111, 119, 92, 142, 222
See application file for complete search history.

(56) References Cited

U.S. PATENT DOCUMENTS

| | | | |
|---|---|---|---|
| 7,587,154 | B2 | 9/2009 | Sakai et al. |
| 7,773,920 | B2 | 8/2010 | Oshikawa |
| 7,826,776 | B2 | 11/2010 | Tsuda et al. |
| 8,036,575 | B2 | 10/2011 | Tsuda |
| 2007/0166074 | A1 | 7/2007 | Hosokawa et al. |
| 2008/0253810 | A1 | 10/2008 | Tateyama et al. |

FOREIGN PATENT DOCUMENTS

| | | | |
|---|---|---|---|
| CN | 101221395 | A | 7/2008 |
| JP | 6-59565 | A | 3/1994 |
| JP | 11-305543 | | 11/1999 |
| JP | 3067406 | | 5/2000 |
| JP | 2002-268377 | | 9/2002 |
| JP | 2006-301173 | A | 11/2006 |
| JP | 2011-039249 | A | 2/2011 |
| JP | 2011-191522 | | 9/2011 |

OTHER PUBLICATIONS

Combined Chinese Office Action and Search Report issued Mar. 25, 2014 in Patent Application No. 201210072671.X (with English language translation).

*Primary Examiner* — Walter L Lindsay, Jr.
*Assistant Examiner* — Roy Y Yi
(74) *Attorney, Agent, or Firm* — Oblon, Spivak, McClelland, Maier & Neustadt, L.L.P.

(57) ABSTRACT

An imaging device provided with a latent image carrying body rotatably disposed to carry a latent image, a developing unit that develops the latent image carried on the carrying body by using a developer containing toner at least, and a duct disposed downstream of the developing unit and having a wall with an upstream suction port and a downstream suction port formed. An air flow path is formed by a surface of the latent image carrying body and a surface of the duct wall, between the upstream suction port and the downstream suction port. A gap of the air flow path is wider at the downstream side than at the upstream side with respect to the rotational direction of the latent image carrying body.

19 Claims, 7 Drawing Sheets

IMAGING DEVICE, IMAGE FORMING APPARATUS, AND PROCESS CARTRIDGE

CROSS-REFERENCE TO RELATED APPLICATIONS

The present application claims priority to and incorporates by reference the entire contents of Japanese Patent Application No. 2011-060797 filed in Japan on Mar. 18, 2011.

BACKGROUND OF THE INVENTION

1. Field of the Invention

The present invention relates to an imaging device including a photosensitive body, a developing unit, and so on, used for an image forming apparatus, such as a copying machine, a facsimile, a printer, and the like. The present invention also relates to an image forming apparatus equipped with the imaging device, and further relates to a process cartridge which serves as the imaging device.

2. Description of the Related Art

In such an image forming apparatus, a latent image is formed on a photosensitive body which serves as a latent image carrying body, and then developed by using powder toner carried on a developing roller which serves as a developer carrying body. A part of the developing roller is exposed from an opening formed on a casing of a developing unit so that the exposed part of the roller faces to the photosensitive body. As a result, the toner may be scattered inside and outside of the apparatus to stain or pollute the surroundings. As one of the methods for suppressing or reducing such a staining or pollution caused by toner scattering, a method has been developed in which toner is collected by an air flow. In particular, widely known is a method in which a duct provided with a suction port is arranged around a developing roller where toner is scattered frequently, thereby collecting the toner intensively.

In the image forming apparatus disclosed in Japanese Patent Application Laid-open No. H6-059565, an air flow unit that collects scattered toner by generating a suction air flow is provided downstream of a developing area in a rotational direction of a photosensitive body. The developing area is an area where a developing roller of a developing unit faces to the photosensitive body. The air flow unit includes a duct that serves as a path of the air flow and that extends in the longitudinal direction of the developing roller, and a pump that is provided to one end of the duct in the longitudinal direction and that generates the air flow. On the wall surface of the duct, a first suction port and a second suction port are formed along the rotational direction of the photosensitive body. The first suction port is located in the vicinity of the photosensitive body and opened toward the surface of the photosensitive body. The second suction port is located upstream of the first suction port in the rotational direction of the photosensitive body. The second suction port is located apart from the photosensitive body and opened toward the developing area. The pump generates the suction air flow in the duct, thereby sucking and collecting the scattered toner around the photosensitive body into the duct from the first suction port and the second suction port. Furthermore, the opening area of the first suction port is smaller than that of the second suction port. By making the opening area of the first suction port smaller than that of the second suction port, it is possible to suck the scattered toner from the first suction port with suction force larger than that of the second suction port. With this configuration, the second suction port having smaller suction force sucks a small amount of toner scattered at a position or area distant from the surface of the photosensitive body first. Subsequently, the first suction port arranged close to the surface of the photosensitive body and having larger suction force sucks a large amount of toner scattered in the vicinity of the surface of the photosensitive body. Thus, the air flow unit distributes the suction force to each suction port appropriately, thereby performing the suction efficiently.

The first suction port is arranged very close to the surface of the photosensitive body in order to suck a large amount of scattered toner from the first suction port in the vicinity of the surface of the photosensitive body. As a result, it is difficult to manage the gap between the first suction port and the surface of the photosensitive body. If the first suction port is arranged excessively close to the surface of the photosensitive body, the wall surface of the duct forming the first suction port comes into contact with the surface of the photosensitive body because of vibrations or the like generated during the rotation of the photosensitive body. As a result, there is a problem in that the surface of the photosensitive body is damaged or scratched.

SUMMARY OF THE INVENTION

It is an object of the present invention to at least partially solve the problems in the conventional technology.

An imaging device is provided with a latent image carrying body that is rotatably disposed to carry a latent image, a developing unit that develops the latent image carried on the latent image carrying body by using a developer containing toner at least, a duct that is disposed downstream of the developing unit with respect to a rotational direction of the latent image carrying body and that has a wall with an upstream suction port and a downstream suction port formed along the rotational direction of the latent image carrying body, and an air flow generating unit that generates an air flow to be drawn into the duct 7 from the upstream suction port and the downstream suction port. An air flow path is formed in the rotational direction of the latent image carrying body by a surface of the latent image carrying body and a surface of the duct wall, between the upstream suction port and the downstream suction port. A gap of the air flow path between the surface of the latent image carrying body and the surface of the duct wall is wider at the downstream side of the rotational direction of the latent image carrying body than at the upstream side of the rotational direction of the latent image carrying body.

An image forming apparatus provided with an imaging device including a latent image carrying body that is rotatably disposed to carry a latent image, a developing unit that develops the latent image carried on the latent image carrying body by using a developer containing toner at least, a duct that is disposed downstream of the developing unit with respect to a rotational direction of the latent image carrying body and that has a wall with an upstream suction port and a downstream suction port formed along the rotational direction of the latent image carrying body, and an air flow generating unit that generates an air flow to be drawn into the duct 7 from the upstream suction port and the downstream suction port. An air flow path is formed in the rotational direction of the latent image carrying body by a surface of the latent image carrying body and a surface of the duct wall, between the upstream suction port and the downstream suction port. A gap of the air flow path between the surface of the latent image carrying body and the surface of the duct wall is wider at the downstream side of the rotational direction of the latent image carrying body than at the upstream side of the rotational direction of the latent image carrying body.

A process cartridge that serves as an imaging device, the imaging device supporting integrally a latent image carrying body and a developing unit at least, and the imaging device attachable to and detachable from an information apparatus body. The process cartridge provided with the latent image carrying body that is rotatably disposed to carry a latent image, the developing unit that develops the latent image carried on the latent image carrying body by using a developer containing toner at least, a duct that is disposed downstream of the developing unit with respect to a rotational direction of the latent image carrying body and that has a wall with an upstream suction port and a downstream suction port formed along the rotational direction of the latent image carrying body, and an air flow generating unit that generates an air flow to be drawn into the duct 7 from the upstream suction port and the downstream suction port. An air flow path is formed in the rotational direction of the latent image carrying body by a surface of the latent image carrying body and a surface of the duct wall, between the upstream suction port and the downstream suction port. A gap of the air flow path between the surface of the latent image carrying body and the surface of the duct wall is wider at the downstream side of the rotational direction of the latent image carrying body than at the upstream side of the rotational direction of the latent image carrying body.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

First Embodiment

An explanation will be made on a tandem-type color laser copying machine (hereinafter, simply referred to as a "copying machine") in which a plurality of photosensitive bodies serving as latent image carrying bodies are arranged side by side, as a first embodiment of an image forming apparatus to which the present invention is applied.

Figure 2:
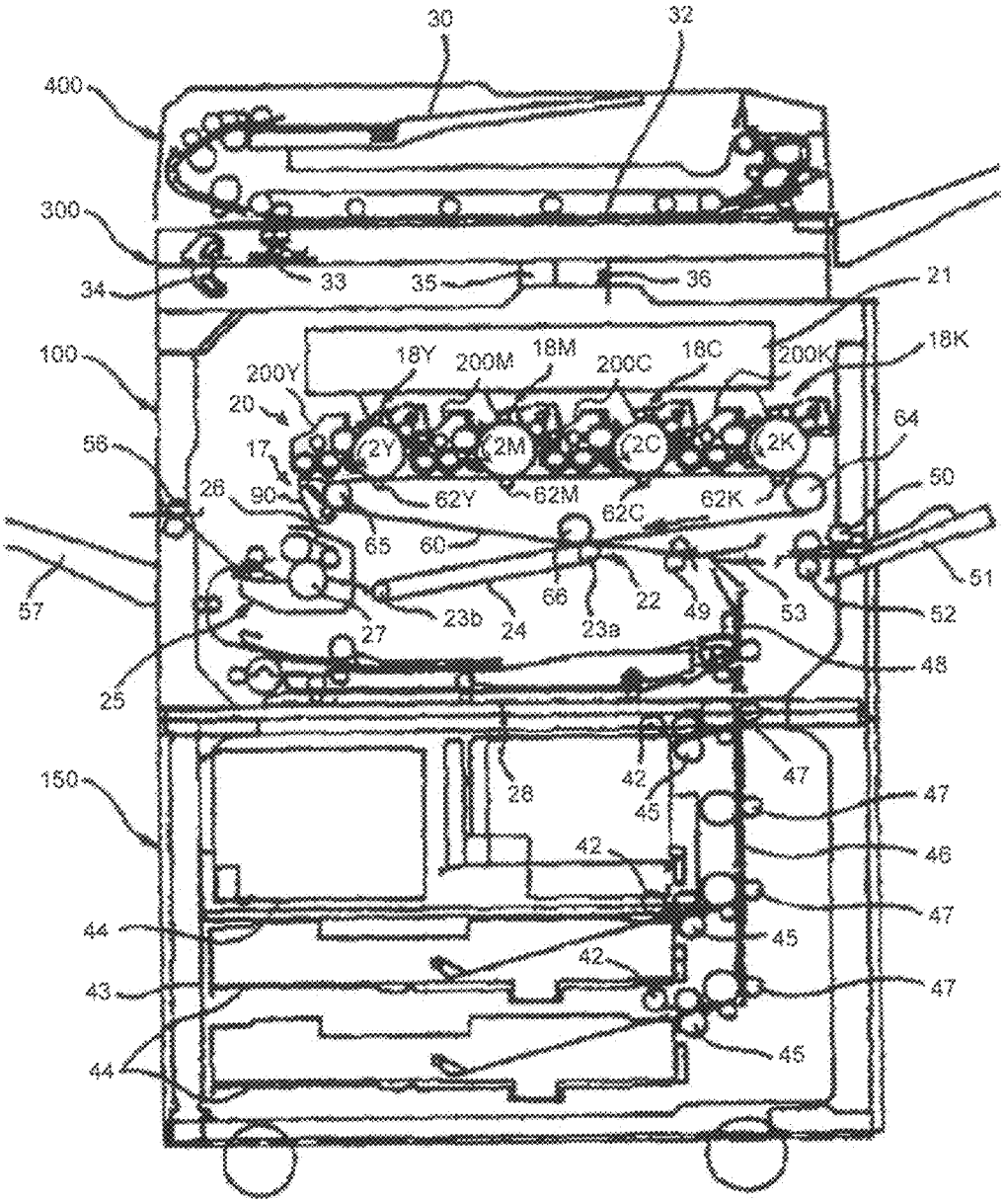
FIG. 2 is a schematic of a configuration of a copying machine according to a first embodiment.

FIG. 2 shows schematically a configuration of the copying machine according to the present embodiment. The copying machine includes a printer unit 100, a feeding device 150 on which the printer unit 100 is placed, and a scanner 300 fixed on the printer unit 100. The copying machine further includes an automatic document feeder 400 fixed on the scanner 300.

The printer unit 100 includes an image forming unit (imaging unit) 20 composed of four process cartridges 18Y, 18M, 180, and 18K for forming images in colors of yellow (Y), magenta (M), cyan (C), and black (K), respectively. Y, M, C, and K assigned after numbers in reference numerals indicate that components with the reference numerals are members for the colors of yellow, magenta, cyan, and black (as the case may be).

The process cartridges 18Y, 18M, 18C, and 18K are imaging devices configured to be attachable to and detachable from the image forming apparatus body. Each process cartridge includes a photosensitive drum 2 which is a drum shaped photosensitive body, a charging unit, a developing unit 200, a drum cleaning unit, a neutralizing unit and the like, which are assembled integrally as the process cartridge.

Alternatively, the photosensitive drum 2, the charging unit, the developing unit 200, the drum cleaning device, the neutralizing unit and the like may not be assembled integrally as the process cartridge and they may be assembled separately to the image forming apparatus main body to form the imaging device or image forming unit.

In addition to the process cartridges 18Y, 18M, 180, and 18K, an optical writing unit 21, an intermediate transfer unit 17, a secondary transfer unit 22, a pair of registration rollers 49, a fixing device 25 of a belt fixing type, and the like are provided.

The optical writing unit 21 includes a light source, a polygon mirror, an f-θ lens, and a reflecting mirror, which are not illustrated, and irradiates the surface of the photosensitive body, which will be described later, with laser light based on image data.

The process cartridge 18 for yellow will now be described.

A charger serving as the charging unit uniformly charges the surface of the photosensitive drum 2Y. The surface of the photosensitive drum 2Y thus charged is irradiated with the laser light modulated and deflected by the optical writing unit 21. As a result, the electric potential of the irradiated portion (exposed portion) decays. With this decay, an electrostatic latent image for Y is formed on the surface of the photosensitive drum 2Y. The electrostatic latent image for Y thus formed is developed into a Y toner image by the developing unit 200Y serving as the developing device.

The Y toner image formed on the photosensitive drum 2Y for color Y is primarily transferred onto an intermediate transfer belt 60, which will be described later. The transfer residual toner on the surface of the photosensitive drum 2Y after the primary transfer is removed by the drum cleaning unit.

In the process cartridge 18Y for color Y, the photosensitive drum 2Y cleaned by the drum cleaning unit is neutralized by the neutralizing unit. Subsequently, the photosensitive drum 2Y is uniformly charged by the charger, and returns to the initial state. The series of processes described above is also applied to the other process cartridges 18M, 18C, and 18K.

The intermediate transfer unit 17 will now be described.

The intermediate transfer unit 17 includes the intermediate transfer belt 60 and a belt cleaning device 90. Furthermore, the intermediate transfer unit 17 includes a tension roller 64, a driving roller 65, a secondary transfer backup roller 66, and four primary transfer bias rollers 62Y, 62M, 62C, and 62K.

The intermediate transfer belt 60 is stretched across a plurality of rollers including the tension roller 64. The intermediate transfer belt 60 is caused to move endlessly in the clockwise direction in FIG. 2 by rotation of the driving roller 65 driven by a belt driving motor, which is not illustrated.

The four primary transfer bias rollers 62Y, 62M, 62C, and 62K are arranged in a manner coming into contact with the inner periphery of the intermediate transfer belt 60, and a primary transfer bias is applied thereto from a power supply, which is not illustrated. Furthermore, the primary transfer bias rollers 62Y, 62M, 62C, and 62K press the intermediate transfer belt 60 against the photosensitive bodies 2Y, 2M, 2C, and 2K, respectively, from the inner periphery of the intermediate transfer belt 60, thereby forming primary transfer nips. In each of the primary transfer nips, a primary transfer electrical field is formed between the photosensitive bodies 2Y, 2M, 2C, and 2K and the primary transfer bias rollers 62Y, 62M, 62C, and 62K, respectively, by the influence of the primary transfer bias.

The Y toner image formed on the photosensitive drum 2Y for color Y, which is described above, is primarily transferred onto the intermediate transfer belt 60 by the influences of the primary transfer electrical field and the pressure in the nip. On the Y toner image, M, C, and K toner images formed on the photosensitive bodies 2M, 2C, and 2K for colors M, C, and K, respectively, are superimposed sequentially to be primarily transferred. By superimposing and primarily transferring the toner images in this manner, a four-color superimposed toner image (hereinafter, referred to as a four-color toner image), which is a multiple toner image, is formed on the intermediate transfer belt 60.

The four-color toner image superimposed and transferred onto the intermediate transfer belt 60 is secondarily transferred onto a transfer sheet serving as a recording medium, which is not illustrated, at a secondary transfer nip, which will be described later. The transfer residual toner on the surface of the intermediate transfer belt 60 after passing through the secondary transfer nip is removed by the belt cleaning unit 90 that sandwiches the belt with the driving roller 65 on the left side in FIG. 2.

The secondary transfer unit 22 will now be described.

The secondary transfer unit 22 in which a sheet conveying belt 24 is stretched across two tension rollers 23*a* and 23*b* is arranged below the intermediate transfer unit 17 in FIG. 2. The sheet conveying belt 24 is caused to move endlessly in the counterclockwise direction in FIG. 2 by rotary drive of at least one of the tension rollers 23. The tension roller 23*a* sandwiches the intermediate transfer belt 60 and the sheet conveying belt 24 with the secondary transfer backup roller 66 of the intermediate transfer unit 17. By sandwiching the belts in this manner, the secondary transfer nip is formed in which the intermediate transfer belt 60 of the intermediate transfer unit 17 and the sheet conveying belt 24 of the secondary transfer unit 22 come into contact with each other. A secondary transfer bias having a reverse polarity to that of the toner is applied to the tension roller 23*a* by a power supply, which is not illustrated. By applying the secondary transfer bias in this manner, a secondary transfer electrical field is formed in the secondary transfer nip. The secondary transfer electrical field electrostatically moves the four-color toner image on the intermediate transfer belt 60 of the intermediate transfer unit 17 from the intermediate transfer belt 60 to the tension roller 23*a*. The transfer sheet is fed to the secondary transfer nip by the pair of registration rollers 49, which will be described later, so as to synchronize with the four-color toner image on the intermediate transfer belt 60. Subsequently, the four-color toner image influenced by the secondary transfer electrical field and the pressure in the nip is secondarily transferred onto the transfer sheet. Instead of applying the secondary transfer bias to the tension roller 23*a*, a non-contact type charger to charge the transfer sheet without any contact may be used for the secondary transfer process.

In the feeding device 150 provided to the lower part of the copying machine main body, a plurality of paper cassettes 44 capable of storing therein a plurality of transfer sheets in a manner stacked as a sheet bundle are arranged in a manner stacked in the vertical direction. Each of the paper cassettes 44 presses a paper feeding roller 42 against the uppermost transfer sheet of the sheet bundle. By rotating the paper feeding roller 42, the uppermost transfer sheet is fed to a feed path 46.

The feed path 46 that receives the transfer sheet fed from the paper cassette 44 includes a plurality of pairs of carriage rollers 47 and the pair of registration rollers 49 arranged in the vicinity of an end of the path. The transfer sheet is conveyed to the pair of registration rollers 49. The transfer sheet conveyed to the pair of registration rollers 49 is sandwiched between the rollers of the pair of registration rollers 49. The four-color toner image formed on the intermediate transfer belt 60 in the intermediate transfer unit 17 enters the secondary transfer nip described above in association with the endless movement of the belt. The pair of registration rollers 49 feeds the transfer sheet sandwiched between the rollers at an operational timing for tightly attaching the four-color toner image with the transfer sheet at the secondary transfer nip. As a result, the four-color toner image on the intermediate transfer belt 60 tightly attach with the transfer sheet at the secondary transfer nip. Subsequently, the four-color toner image is secondarily transferred onto the transfer sheet and turned to be a full-color image on the white transfer sheet. The transfer sheet on which the full-color image is formed in this manner leaves the secondary transfer nip in association with the endless movement of the sheet conveying belt 24, and is conveyed from the sheet conveying belt 24 to the fixing unit 25.

The fixing device 25 includes a belt unit that causes a fixing belt 26 to move endlessly while stretching the fixing belt 26 across two rollers, and a pressing roller 27 pressed against one of the rollers of the belt unit. The fixing belt 26 and the pressing roller 27 come into contact with each other to form a fixing nip, and sandwich the transfer sheet received from the sheet conveying belt 24 by the nip. The roller pressed by the pressing roller 27 of the two rollers in the belt unit has a heat source, which is not illustrated, inside thereof, and presses the fixing belt 26 by the heat generated from the heat source. The fixing belt 26 thus pressed heats the transfer sheet sandwiched by the fixing nip. Thus, the full-color image is fixed to the transfer sheet by the influences of the heating and the pressure in the nip.

The transfer sheet on which the fixing is performed in the fixing unit 25 is staked on a stacking unit 57 provided outside of a left side plate of the printer housing in FIG. 2, or is conveyed back to the secondary transfer nip described above so as to form a toner image on the other surface thereof.

To copy an original or document, which is not illustrated, a bundle of sheet documents is set on a document table 30 of the automatic document feeder 400, for example. However, when the documents or originals are bound at one side to form a book shape, the book shaped original is set on an exposure glass 32. Prior to the setting, the automatic document feeder 400 is opened with respect to the copying machine main body, and the exposure glass 32 of the scanner 300 is exposed. Subsequently, the automatic document feeder 400 is closed, thereby pressing the book shaped original bound at one side.

The present copying machine includes a control unit (not illustrated) and an operation display unit (not illustrated). The control unit includes a central processing unit (CPU) and the like to control the devices in the copying machine. The operation display unit includes a liquid crystal display, various types of key buttons, and the like for example.

After the original is set as described above, if a copy start switch of the operation display unit, which is not illustrated, is pressed, the scanner 300 starts an document scanning operation. However, if the sheet original is set on the automatic document feeder 400, the automatic document feeder 400 automatically moves the sheet original to the exposure glass 32 prior to the document scanning operation. In the document scanning operation, a first running body 33 and a second running body 34 start running together, and light is output from a light source provided to the first running body 33. Subsequently, light reflected from the surface of the original is reflected by a mirror provided in the second running body 34. The light then passes through an imaging lens 35, and is incident on a scanning sensor 36. The scanning sensor 36 creates image information on the basis of the incident light.

In parallel to such a document scanning operation, the devices in each of the process cartridges 18Y, 18M, 18C, and 18K, the intermediate transfer unit 17, the secondary transfer unit 22, and the fixing unit 25 start driving. The optical writing unit 21 is then controlled to drive on the basis of the image information created by the scanning sensor 36, whereby Y, M, C, and K toner images are formed on the photosensitive drums 2Y, 2M, 2C, and 2K, respectively. These toner images are superimposed and transferred onto the intermediate transfer belt 60 to be a four-color toner image.

Furthermore, at approximately the same time as the start of the document scanning operation, a paper feeding operation is started in the feeding device 150. In the paper feeding operation, one of the paper feeding rollers 42 is selectively rotated, whereby transfer sheets are fed from one of the paper cassettes 44 stored in a multistage manner in a paper bank 43. A separating roller 45 forwards the transfer sheets thus fed, one by one, to the feed path 46. Subsequently, the pair of carriage rollers 47 conveys the transfer sheet to the secondary transfer nip. Instead of paper feeding from the paper cassette 44 in this manner, paper feeding from a bypass tray 51 (a tray allowing a manual feeding) may be performed. In this case, a bypass paper feeding roller 50 is selectively rotated, thereby feeding transfer sheets on the bypass tray 51. Subsequently, a separating roller 52 forwards the transfer sheets, one by one, to a bypass feed path 53 of the printer unit 100.

When forming a multicolor image made of two or more color toners, the present copying machine stretches the intermediate transfer belt 60 so that the upper stretched surface of the belt 60 extends in an approximately horizontal direction, and all the photosensitive drums 2Y, 2M, 2C, and 2K come into contact with the upper stretched surface. By contrast, when forming a monochrome image made of only the K toner, it is possible to tilt the intermediate transfer belt 60 toward the lower left direction in FIG. 2 by a mechanism, which is not illustrated, so that the upper stretched surface is spaced from the photosensitive drums 2Y, 2M, and 2C for Y, M, and C. Subsequently, the copying machine rotates the photosensitive drum 2K for K alone in the counterclockwise direction in FIG. 2 among the four photosensitive drums 2Y, 2M, 2C, and 2K, thereby forming a K toner image alone. At this time, the copying machine stops driving not only the photosensitive drums 2 for Y, M, and C, but also the developing units for them to prevent unnecessary consumption of the photosensitive drums and developers.

Figure 3:
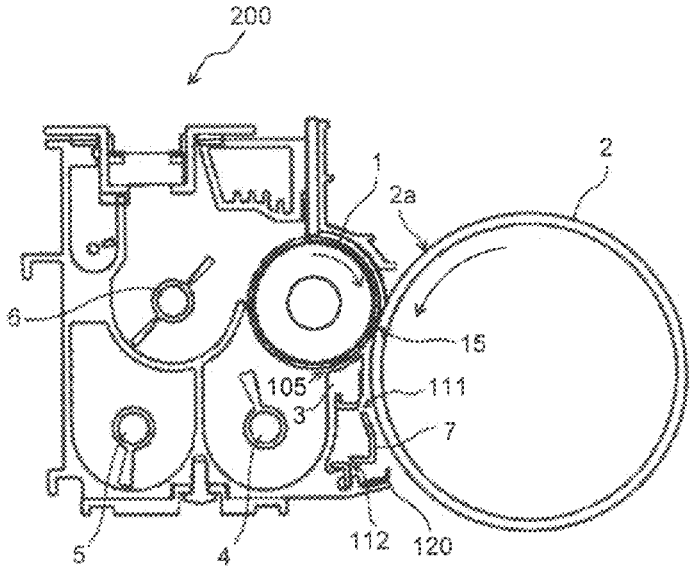
FIG. 3 is a sectional view of a developing unit.
Figure 4:
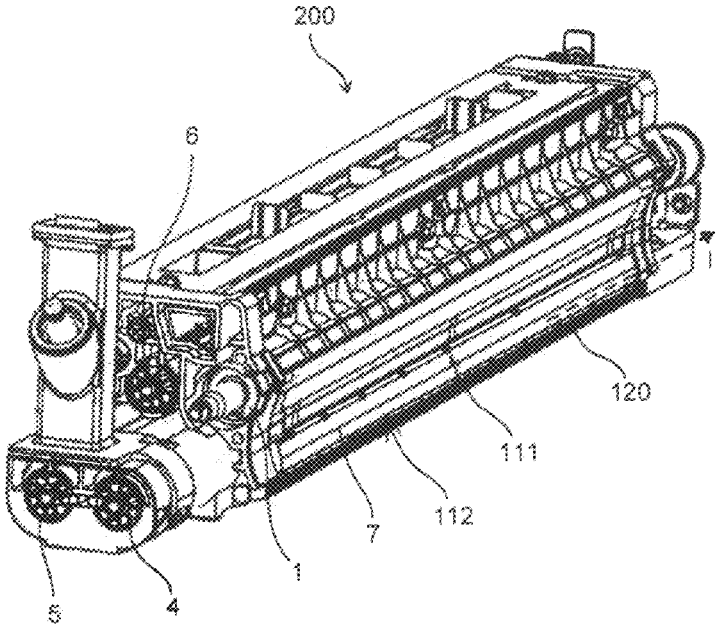
FIG. 4 is a perspective view of the developing unit.

FIG. 3 is a sectional view of the developing unit 200, and FIG. 4 is a perspective view of the developing unit 200.

For the developing unit 200, an OD developing method is employed in which the developer circulates in one direction in a casing 3. In the casing 3, an internal space for storing therein the developer is formed, and an opening is provided through which a part of the surface of the developing roller faces to the photosensitive drum 2. The developer is conveyed toward a depth direction from the plane of FIG. 3 by a stirring screw 5, is lifted up at the end, and is conveyed toward the front by a supplying screw 6. A developing roller 1 draws up the developer conveyed by the supplying screw 6, and uses the developer to develop the toner on the photosensitive drum 2 serving as a latent image carrying body. The developer after being used for the development is collected by a collecting screw 4, and returns to the stirring screw 5.

In the continuous flow of the developer, the toner scattering is concerned about an area around the developing roller, specifically downstream area, with respect to a rotational direction of the developing roller, of a nip 15 between the developing roller 1 and the photosensitive drum 2. If the scattered tonner leaks out of the developing unit, the scattered toner may causes a stain inside and outside of the apparatus and/or an abnormal image. Therefore, it is required to suppress the toner scattering.

In the configuration illustrated in FIG. 3, the toner scattered at the area downstream of the nip 15 in the rotational direction of the developing roller is collected by the suction air flows, such as a suction air flow originated from outer air flowing into an inner space of the casing 3 (the developing unit) in association with the rotation of the developing roller 1, through a path 105 which is a gap allowing the inflow of the air and which is formed between the surface of the developing roller 1 and the edge of the casing at the downstream side of the opening in the rotational direction of the developing roller, or a suction flow I which is generated by a pump (not illustrated) and which is sucked into the duct 7 via the upstream suction port 111 and the downstream suction port 112 formed along the longitudinal duct 7 which is formed along the longitudinal direction of the developing roller or the axial direction of the photosensitive drum arranged downstream of the nip 15 in the rotational direction of the developing roller 1.

Figure 5:
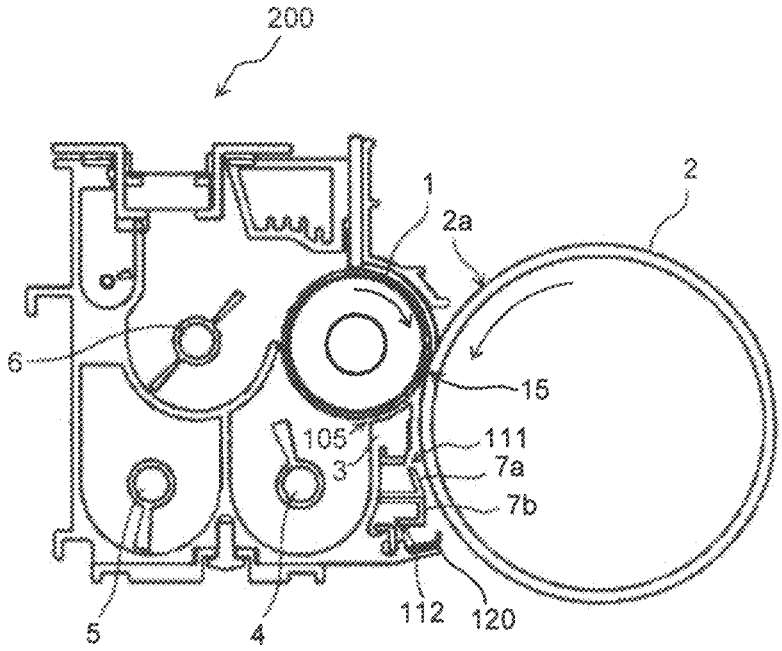
FIG. 5 is a sectional view of the developing unit when different ducts are used for an upstream suction port and a downstream suction port, respectively.

In the present embodiment, the upstream suction port 111 and the downstream suction port 112 share the duct 7. However, a duct 7*a* and a duct 7*b* may be provided for the upstream suction port 111 and the downstream suction port 112, respectively, as illustrated in FIG. 5. In this case, if different pumps generating the suction air flow I are provided to the duct 7*a* and the duct 7*b*, respectively, the flow amount of the suction air flow I can be adjusted for each duct, for example. As a result, it is possible to facilitate adjusting the flow amount of the air flow sucked into the duct 7*a* through the upstream suction port 111 and that of the air flow sucked into the duct 7*b* through the downstream suction port 112. By contrast, if the pump generating the suction air flow I is shared by the duct 7*a* and the duct 7*b*, the number of pumps can be reduced. As a result, it is possible to save space in the unit and to reduce costs.

Figure 1:
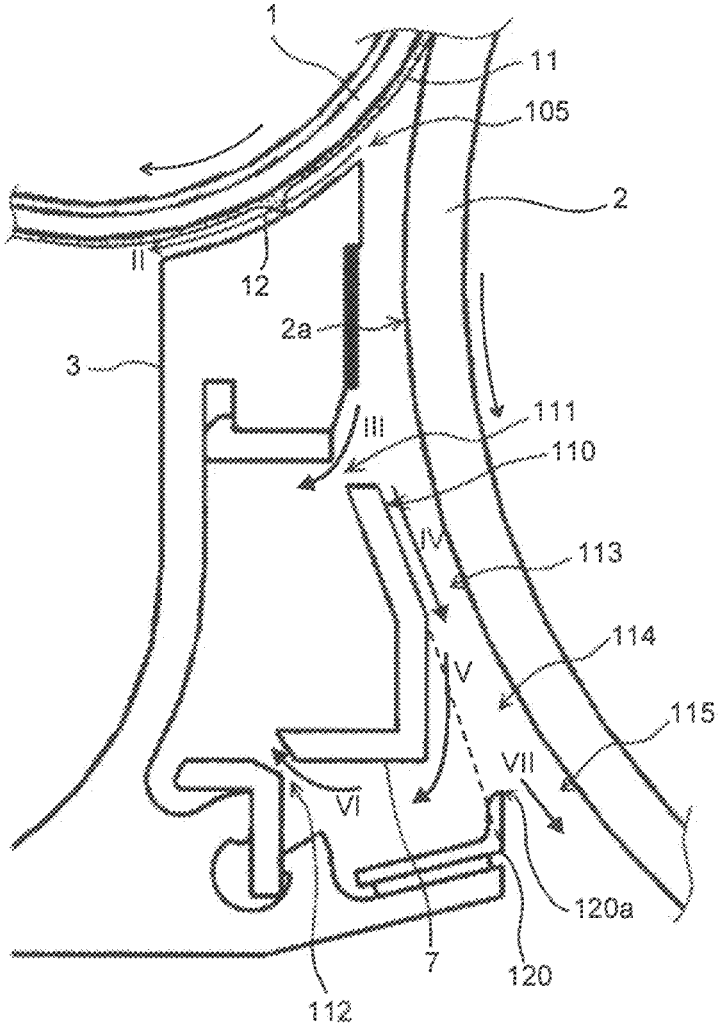
FIG. 1 is an enlarged view of the vicinity of a gap between a developing roller and a casing.

Explanations will be made on a path of the toner scattered from the developing roller 1, the suction air flow flowing through the path 105 between the developing roller 1 and the casing 3, and the suction air flows flowing through the upstream suction port 111 and the downstream suction port 112 formed on and along the duct 7. An arrow II in FIG. 1 represents an air flow II sucked into the developing unit through the path 105 formed between the developing roller 1 and the casing 3. An arrow III in FIG. 1 represents an air flow III which is sucked into the duct 7 via the upstream suction port 111 of the duct 7 and which is generated by using a pump (not illustrated) attached to the end of the duct 7 on the depth side of FIG. 1. An arrow VI in FIG. 1 represents an air flow VI which is sucked into the duct 7 via the downstream suction port 112 of the duct 7.

FIG. 1 is an enlarged view of the vicinity of the path 105 between the developing roller 1 and the casing 3. The air flow II in the path 105 is an air flow generated along the surface of the developing roller in association with the rotation of the developing roller 1. Specifically, with a protruding portion 12 of a developer 11 on the developing roller 1 coming into contact with the casing 3, when the developing roller 1 rotates in the clockwise direction in FIG. 1 to convey the developer 11, the protruding portion 12 draws air into the developing unit in association with the rotation of the developing roller 1. As a result, the air flow II is generated.

Although the strength of the air flow II can be adjusted by the width of the path 105, it is difficult to adjust the strength to the relatively high level. This is because, if a large amount of air is sucked into the casing 3 (developing unit 200), the internal pressure of the casing 3 (developing unit 200) increases. As a result, the pressure of the air flow II may come into balance with the internal pressure of the casing 3 (developing unit 200) somewhere in the longitudinal direction of the developing roller in the path 105. Otherwise, the internal pressure of the casing 3 (developing unit 200) may become higher than the pressure of the air flow II, whereby the gas in the casing 3 (developing unit 200) may adversely blow out therefrom. Therefore, there is a limit to the strength of the air flow II to be set for the path 105.

An explanation will be made on the air flow III sucked into the duct 7 from the upstream suction port 111 of the duct 7 for collecting the scattered toner around the photosensitive drum 2. As described above, since there is a limit to the strength of the air flow II, the air flow II alone is not enough to collect the scattered toner. Therefore, the scattered toner that fails to be collected is sucked and collected into the duct 7 from the upstream suction port 111 of the duct 7 by the air flow III.

Figure 6:
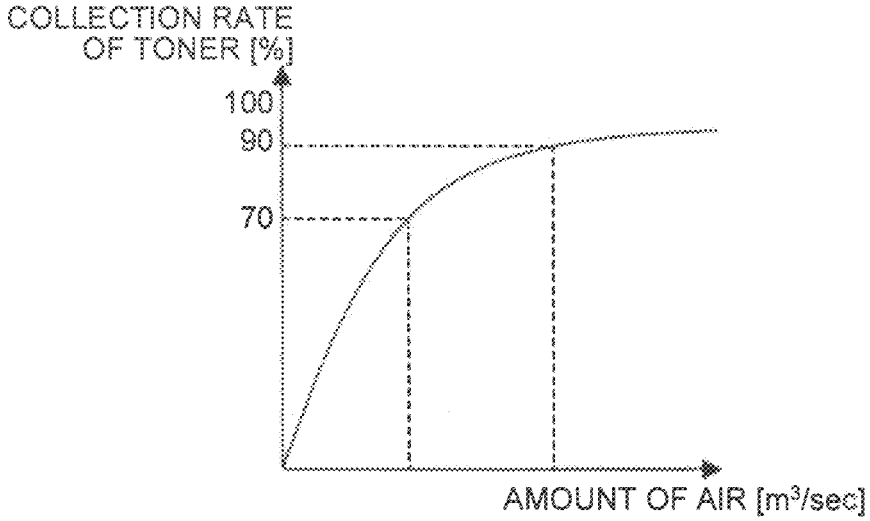
FIG. 6 is a graph illustrating a relationship between an amount of air flow at the upstream suction port and the collection rate of toner.

As illustrated in FIG. 6, the relationship between the amount of the air flow III at the upstream suction port 111 and the amount of sucked toner linearly shifts to a certain extent. In other words, as the amount of the air flow III increases, the amount of sucked toner increases. However, if the amount of the air flow III becomes equal to or larger than a certain value, the amount of sucked toner remains approximately flat. This is because some toner is drawn by an air flow generated by rotation of the photosensitive drum 2. However, if the amount of the air flow III is set too large in order to suck and collect such toner from the upstream suction port 111 as much as possible, the air flow around the developing roller is disturbed. As a result, the air flow II is disturbed, thereby sucking extra toner not to be collected as well. Therefore, it is preferable that the amount of the air flow III be maintained up to the strength with which the amount of sucked toner is approximately 70% in FIG. 6.

Furthermore, by setting a gap L1 (refer to FIG. 7) between a duct wall surface 110 and a photosensitive drum surface 2*a* in a path 113 as narrow as possible, it is possible to collect the toner efficiently. However, if the gap L1 is too narrow, the toner of the image developed on the photosensitive drum 2 is also sucked or drawn. Therefore, the gap L1 is preferably set to approximately 1 mm to 3 mm. In the present embodiment, the gap L1 is set to 2 mm.

Figure 7:
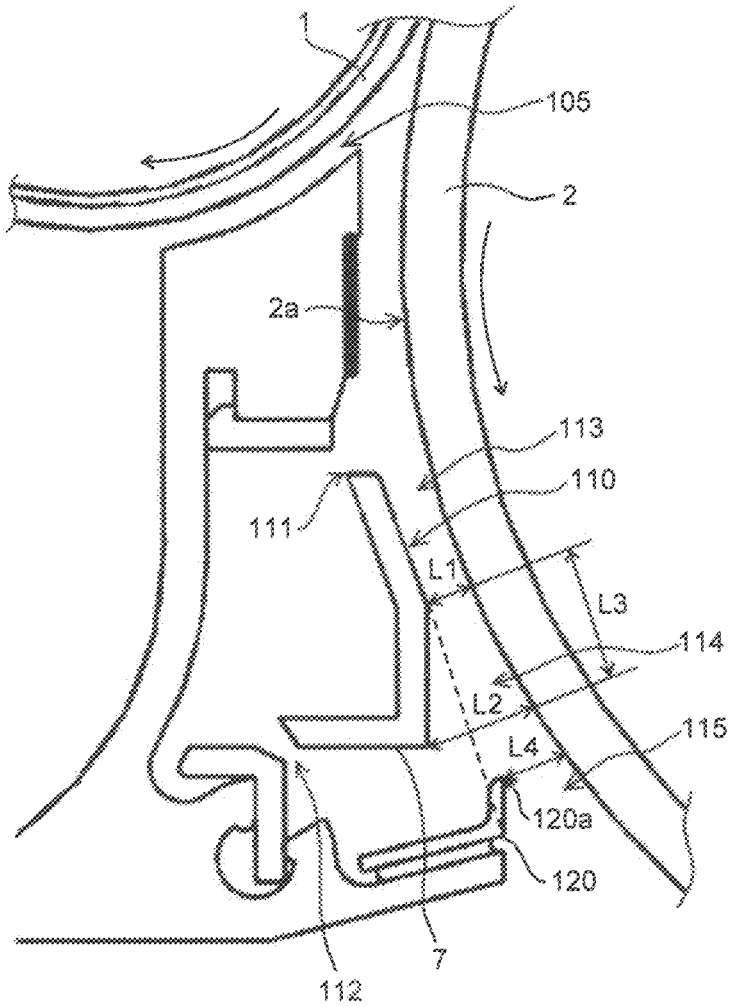
FIG. 7 is a schematic view for explaining the size of a gap in a path.

In the present embodiment, as illustrated in FIG. 7, a gap (width) of the path 114, which is continuous from the path 113 having the gap L1 (2 mm in this example) between the duct wall surface 110 and the photosensitive drum surface 2*a*, becomes wider from the most upstream side of the path 114 to the most downstream side of the path 114. The gap L2 between the duct wall surface 110 and the photosensitive drum surface 2*a* is 4 mm at the most downstream side of the path 114. In the present embodiment, the distance L3 is 6 mm between the most upstream side of the path 114 (the most downstream side of the path 113) and the most downstream side of the path 114.

The gap of the path 114 becomes wider at the downstream side in the rotational direction of the photosensitive drum than at the upstream side in the rotational direction of the photosensitive drum. As a result, an air flow V flowing away from the photosensitive drum surface 2*a* is generated at the downstream side of the path 114 in the rotational direction of the photosensitive drum. With the generation of the air flow V flowing away from the photosensitive drum surface 2*a*, the scattered toner that is not sucked from the upstream suction port 111 and thereby remains in the vicinity of the photosensitive drum surface 2*a* can be diffused in a direction departing from the photosensitive drum surface 2*a*. The scattered toner diffused in this manner is carried by the air flow VI, and is sucked from the downstream suction port 112 to be collected into the duct 7.

Thereby, the scattered toner existing in the vicinity of the photosensitive drum surface 2*a* can be drawn from the downstream suction port 112 by diffusing the toner in the above-mentioned space from the photosensitive drum surface 2*a* without arranging the downstream suction port 112 close to the photosensitive drum surface 2*a*. Thereby, it is possible to prevent the downstream suction port 112 from contacting with the photosensitive drum surface 2*a*, which may be caused by the vibration or the like generated during the rotational movement of the photosensitive drum, in the case that the downstream suction port 112 is arranged excessively close to the photosensitive drum surface 2*a*. As a result, it is possible to prevent the photosensitive drum surface 2*a* from being damaged.

Furthermore, there is no need to excessively increase the amount of the air flow III. Thereby, it is possible to prevent the air flow from being disturbed around the developing roller. Thereby, it is possible to surely collect the scattered toner into the duct 7 from the upstream suction port 111 and the downstream suction port 112, without excessively drawing the toner not to be collected into the duct 7 from the upstream suction ort 111.

In the present embodiment, the downstream suction port 112 is opened downward. Furthermore, a toner tray 120 made of rubber serving as a toner receiving unit that receives toner is provided to a position opposite to the downstream suction port 112 downstream of the most downstream side of the path 114 in the rotational direction of the photosensitive drum. A tip 120*a* of the toner tray 120 is positioned closer to the photosensitive drum surface 2*a* than a line (dashed line in the figure) when extended from the duct wall surface 110 forming the path 113. With this configuration, even if a lump of toner incapable of being carried by the air flow slides down swiftly, the portion protruding toward the photosensitive drum surface 2*a* in the tip 120*a* of the toner tray 120 facilitates receiving the dropping toner. As a result, it is possible to reduce toner dropping onto an image. Furthermore, because the toner tray 120 can catch a part of toner carried by an air flow VII, it is possible to minimize the toner scattering outside of the device.

At this time, if the tip 120*a* of the toner tray 120 is arranged excessively close to the photosensitive drum surface 2*a*, the toner of the image developed on the photosensitive drum 2 may also be adversely drawn or sucked in. Otherwise, the vibration or the like generated during the rotational movement of the photosensitive drum may cause the tip 120*a* of the toner tray 120 to come into contact with the photosensitive drum surface 2*a*, resulting in the damage on the photosensitive drum surface 2*a*.

Therefore, a gap L4 (refer to FIG. 7) between the tip 120*a* of the toner tray 120 and the photosensitive drum surface 2*a* is preferably set to approximately 1 mm to 3 mm. According to this configuration, it is possible to prevent the toner of the developed image on the photosensitive drum 2 from being adversely drawn or sucked in. It is also possible to prevent the contact between the tip 120*a* of the toner tray 120 and the photosensitive drum surface 2*a*, which may be caused by the vibration or the like generated during the rotational movement of the photosensitive drum, and thereby prevent the damage on the photosensitive drum surface, which may be caused by the contact with the tip 120*a* of the toner tray 120.

Second Embodiment

An explanation will be made on a tandem-type color laser copying machine (hereinafter, simply referred to as a "copying machine") in which a plurality of photosensitive drums or drums are arranged side by side, as a second embodiment of an image forming apparatus to which the present invention is applied. The basic configuration of the copying machine according to the second embodiment is the same as that of the copying machine according to the first embodiment. Therefore, the explanation thereof will be omitted.

Figure 8:
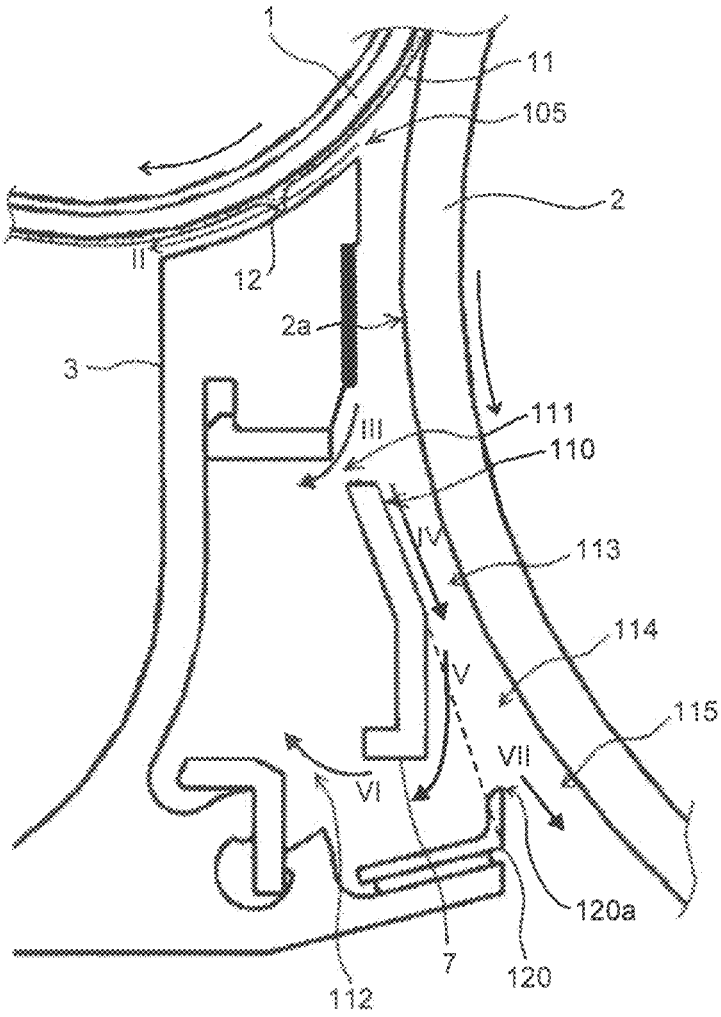
FIG. 8 is another enlarged view of the vicinity of the gap between the developing roller and the casing.

FIG. 8 is an enlarged view of the vicinity of a path 105 between a developing roller 1 and a casing 3.

In the present embodiment as wall, as illustrated in FIG. 8, the toner scattered at an area downstream of a nip 15 in the rotational direction of the developing roller is collected by the air flows, such as an air flow II originated from an outer air flowing into the internal space in the casing 3 (developing unit) in association with the rotation of the developing roller 1, through the path 105 which is a gap formed between the surface of the developing roller 1 and the edge of the casing 3 at the downstream side of the opening relative to the rotational direction of the developing roller, or a suction flow I which is generated by a pump (not illustrated) and which is sucked into the duct 7 via the upstream suction port 111 and the downstream suction port 112 formed along the longitudinal duct 7. The duct 7 is formed along the longitudinal direction of the developing roller, and is arranged downstream of the nip 15 in the rotational direction of the developing roller 1.

In the present embodiment, the upstream suction port 111 and the downstream suction port 112 share the duct 7. With this configuration, the number of ducts 7 and the number of pumps described above can be reduced compared with the case where different ducts 7 and different pumps described above are provided to the upstream suction port 111 and the downstream suction port 112, respectively. As a result, it is possible to save space in the unit and to reduce costs.

Furthermore, by setting a gap L1 (refer to FIG. 9) between a duct wall surface 110 and a photosensitive drum surface 2*a* in a path 113 as narrow as possible, it is possible to collect the toner efficiently. However, if the gap L1 is too narrow, the toner of the image developed on the photosensitive drum 2 is also adversely sucked or drawn in. Therefore, the gap L1 is preferably set to approximately 1 mm to 3 mm. In the present embodiment, the gap L1 is set to 2 mm.

Figure 9:
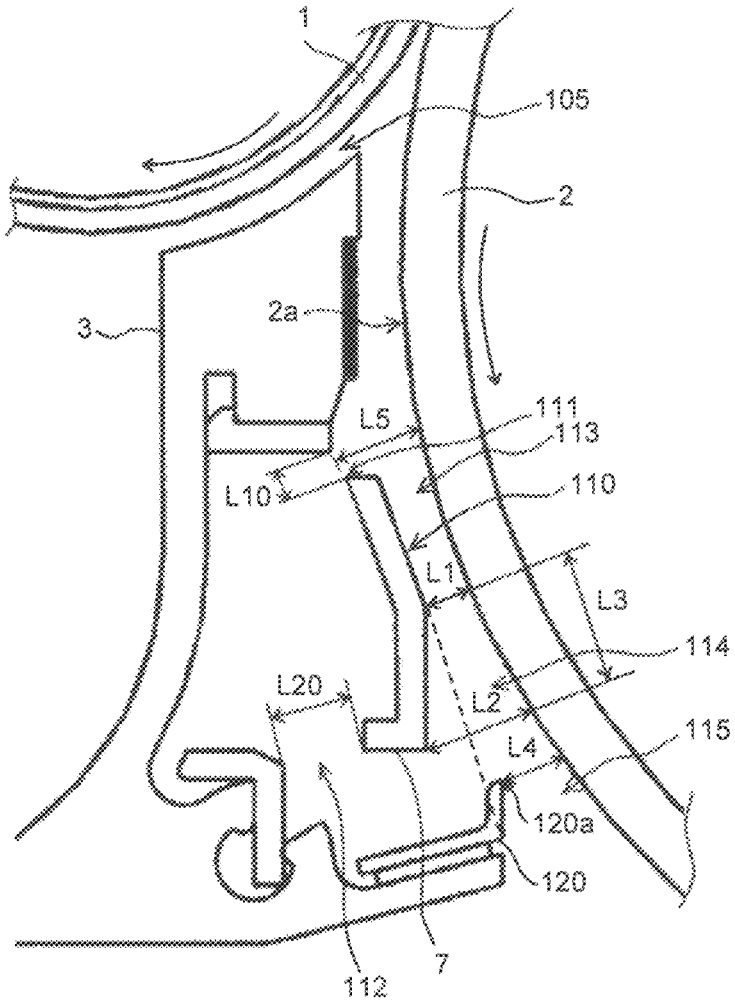
FIG. 9 is a schematic view for explaining the size of the gap in the path and the size of the opening width of the suction port.

In the present embodiment, as illustrated in FIG. 9, a gap (width) of the path 114, which is continuous from the path 113 having the gap L1 (2 mm in this example) between the duct wall surface 110 and the photosensitive drum surface 2*a*, becomes wider from the most upstream side of the path 114 to the most downstream side of the path 114. The gap L2 between the duct wall surface 110 and the photosensitive drum surface 2*a* is 4 mm at the most downstream side of the path 114. In the present embodiment, the distance L3 is 6 mm between the most upstream side of the path 114 (the most downstream side of the path 113) and the most downstream side of the path 114.

The gap of the path 114 becomes wider at the downstream side in the rotational direction of the photosensitive drum than at the upstream side in the rotational direction of the photosensitive drum. As a result, an air flow V flowing away from the photosensitive drum surface 2*a* is generated at the downstream side of the path 114 in the rotational direction of the photosensitive drum. With the generation of the air flow V flowing away from the photosensitive drum surface 2*a*, the scattered toner that is not sucked from the upstream suction port 111 and thereby remains in the vicinity of the photosensitive drum surface 2*a* can be diffused in a direction departing from the photosensitive drum surface 2*a*. The scattered toner diffused in this manner is carried by the air flow VI, and is sucked from the downstream suction port 112 to be collected into the duct 7.

Furthermore, as explained in the first embodiment, if the amount of an air flow III is set excessively large in order to suck and collect the scattered toner through the upstream suction port 111, the air flow around the developing roller is disturbed. As a result, the air flow II is disturbed, thereby sucking extra toner not to be collected into the duct 7 as well. Therefore, it is preferable that the amount of the air flow III be kept to the strength with which the amount of sucked toner is approximately 70% in FIG. 6.

Therefore, in the present embodiment, as illustrated in FIG. 9, an opening width L10 of the upstream suction port 111 is smaller than an opening width L20 of the downstream suction port 112 in a section along a direction perpendicular to the longitudinal direction of the duct 7. With this configuration, if the upstream suction port 111 and the downstream suction port 112 share the duct 7, the amount of the air flow III decreases and the flow velocity thereof increases at the upstream suction port 111 compared with the downstream suction port 112. As a result, it is possible to suck the toner scattered existing around an area apart from the photosensitive drum surface 2*a* reliably.

To decrease the amount of the air flow III in this manner, a gap 15 (refer to FIG. 9) between the upstream suction port 111 and the photosensitive drum surface 2*a* is preferably set to 1 mm to 3 mm. With this configuration, the upstream suction port 111 is arranged in the vicinity of the photosensitive drum surface 2*a*. Therefore, the air flow around the developing roller is prevented from being disturbed with the excessively large amount of the air flow III. As a result, it is possible to suck and collect a large amount of scattered toner with as small amount of air as possible through the upstream suction port 111 while suppressing sucking of extra toner not to be collected into the duct 7 through the upstream suction port 111.

In the present embodiment, the scattered toner in the vicinity of the photosensitive drum surface 2*a* can be diffused away from the photosensitive drum surface 2*a* to be sucked through the downstream suction port 112 without arranging the downstream suction port 112 close to the photosensitive drum surface 2*a*. Therefore, it is possible to prevent the duct wall surface 110 forming the downstream suction port 112 from coming into contact with the photosensitive drum surface 2*a* because of vibrations generated during rotation of the photosensitive drum and other factors with the downstream suction port 112 arranged too close to the photosensitive drum surface 2*a*. As a result, it is possible to suppress any damage on the photosensitive drum surface 2*a*.

Furthermore, as illustrated in FIG. 8, a toner tray 120 made of rubber serving as a toner receiving unit that receives toner is provided to a position opposite to the downstream suction port 112 downstream of the most downstream side of the path 114 in the direction of rotation of the photosensitive drum. With this configuration, even if a large lump of toner incapable of being carried by the air flow slides down swiftly, the toner tray 120 can receive the lump of toner.

In particular, a tip 120*a* of the toner tray 120 is positioned closer to the photosensitive drum surface 2*a* than an extension of the duct wall surface 110 of the path 113. With this configuration, the portion protruding toward the photosensitive drum surface 2*a* in the tip 120*a* of the toner tray 120 facilitates receiving the dropping toner. As a result, it is possible to reduce toner dropping onto an image. Furthermore, because the toner tray 120 can catch a part of toner conveyed by an air flow VII, it is possible to minimize the toner scattering outside of the device.

If the tip 120*a* of the toner tray 120 is arranged too close to the photosensitive drum surface 2*a*, the toner of the image developed onto the photosensitive drum 2 may also be drawn or sucked. Otherwise, vibrations generated during rotation of the photosensitive drum and other factors may cause the tip 120*a* of the toner tray 120 to come into contact with the photosensitive drum surface 2*a*, resulting in a damage on the photosensitive drum surface 2*a*. Therefore, a gap 14 (refer to FIG. 9) between the tip 120*a* of the toner tray 120 and the photosensitive drum surface 2*a* is preferably set to approximately 1 mm to 3 mm. With this configuration, it is possible to suppress the adverse sucking of the toner of the developed image on the photosensitive drum 2. Furthermore, it is possible to suppress the damage on the photosensitive drum surface 2*a* which may be caused by the tip 120*a* of the toner tray 120 coming into contact with the photosensitive drum surface 2*a* because of vibrations generated during rotation of the photosensitive drum and other factors.

As described above, according to the present embodiment, an image forming unit includes: the photosensitive drum 2 serving as a latent image carrying body that is provided in a rotatable manner, and that carries a latent image; the developing unit 200 serving as a developing unit that develops the latent image on the photosensitive drum 2 with a developer including at least toner; the duct 7 functioning as a path of an air flow that is provided downstream of the developing unit 200 in the direction of rotation of the photosensitive drum, and in which the upstream suction port 111 and the downstream suction port 112 are formed on the duct wall surface 110, which is a wall surface thereof, along the direction of rotation of the photosensitive drum; and a pump serving as an air-flow generating unit that generates a suction air flow in which a gas is sucked through the upstream suction port 111 and the downstream suction port 112 into the duct 7. In such an image forming unit, the paths 113 and 114 for the air flow are formed by the photosensitive drum surface 2*a* and the duct wall surface 110 between the upstream suction port 111 and the downstream suction port 112 in the direction of rotation of the photosensitive drum. The gap between the photosensitive drum surface 2*a* and the duct wall surface 110 in the paths 113 and 114 is wider at the downstream side in the direction of rotation of the photosensitive drum than at the upstream side in the direction of rotation of the photosensitive drum. As described above, because the gap in the paths 113 and 114 becomes wider at the downstream side in the direction of rotation of the photosensitive drum than at the upstream side in the direction of rotation of the photosensitive drum, the air flow expands and flows in a direction away from the photosensitive drum surface 2*a* at the downstream side of the path 114 in the direction of rotation of the photosensitive drum. With such an expansion and direction of the air flow, the scattered toner that is not sucked from the upstream suction port 111, and that is present in the vicinity of the photosensitive drum surface 2*a* can be diffused in a direction away from the photosensitive drum surface 2*a*. With this configuration, the scattered toner in the vicinity of the photosensitive drum surface 2*a* can be diffused in a direction away from the photosensitive drum surface 2*a* to be sucked from the downstream suction port 112 without arranging the downstream suction port 112 close to the photosensitive drum surface 2*a*. Therefore, it is possible to prevent the duct wall surface 110 forming the downstream suction port 112 from coming into contact with the photosensitive drum surface 2*a* because of vibrations generated during rotation of the photosensitive drum and other factors with the downstream suction port 112 arranged too close to the photosensitive drum surface 2*a*. Thus, it is possible to suppress the damage on the photosensitive drum surface 2*a*.

According to the present embodiment, the duct 7 extends in the axial direction of the photosensitive drum 2, and is shared by the upstream suction port 111 and the downstream suction port 112. The opening width of the upstream suction port 111 is smaller than the opening width of the downstream suction port 112 in a section along a direction perpendicular to the longitudinal direction of the duct 7. With this configuration, the flow velocity of the air flow III increases at the upstream suction port 111 having the opening width smaller than that of the downstream suction port 112. As a result, it is possible to suck the toner scattered existing around an area apart from the photosensitive drum surface 2*a* reliably.

According to the present embodiment, the upstream suction port 111 is arranged at a position closer to the photosensitive drum surface 2*a* than the downstream suction port 112. Therefore, since the opening width of the upstream suction port 111 is smaller than that of the downstream suction port 112, a large amount of flow can not be obtained as the air flow III. However, the flow velocity can be increased locally, thereby making it possible to suck the toner reliably.

According to the present embodiment, the toner tray 120 serving as a toner receiving unit that receives toner is provided below the downstream suction port 112. With this configuration, the toner tray 120 can receive a large lump of toner incapable of being dealt with in the collection of the scattered toner by the air flow. As a result, it is possible to suppress the lump of toner dropping onto an image.

According to the present embodiment, the tip 120*a* of the toner tray 120, which is an end of the tray 120 toward the photosensitive drum, is located closer to the photosensitive drum 2 than an extended line from the duct wall surface 110 forming the path 113. Thereby, it is easier for the toner tray 120 having the tip 120*a* thereof protruding toward the photosensitive drum surface 2*a* to receive the lump of toner which cannot be carried by the air flow and may fall down rapidly. Thereby, it is possible to reduce the toner drop onto the image. Furthermore, it is also possible for the toner tray 120 to catch a part of the toner carried by the air flow VII. Thereby, it is possible to reduce the toner scattering to the outside of the machine to the minimum extent.

According to the present embodiment, the tip 120*a* of the toner tray 120 is arranged at a position 1 mm to 3 mm away from the photosensitive drum surface 2*a*. As a result, it is possible to suppress the adverse drawing or sucking of the toner of the developed image on the photosensitive drum 2. Furthermore, it is possible to suppress the damage on the photosensitive drum surface 2*a* which may be caused by the tip 120*a* of the toner tray 120 coming into contact with the photosensitive drum surface 2*a* because of vibrations generated during rotation of the photosensitive drum and other factors.

According to the present embodiment, at least the tip 120*a* of the toner tray 120, which is an end of the tray 120 at the photosensitive drum side, is formed of one or more rubber material(s). Thus, the tip 120*a* is formed from the soft rubber material. Therefore, even if the tip 120*a* of the toner tray 120 comes into contact with the photosensitive drum surface 2*a* when being assembled for example, it is possible to suppress scratching or any damage on the photosensitive drum surface 2*a*.

According to the present embodiment, the gap between the upstream suction port 111 and the photosensitive drum surface 2*a* is set to 1 mm to 3 mm. As a result, the upstream suction port 111 is arranged in the vicinity of the photosensitive drum surface 2*a*, whereby it is possible to suck and collect a large amount of toner with as small amount of air as possible through the upstream suction port 111.

According to the present embodiment, the developing unit 200 includes: the developing roller 1 serving as a developer carrying body that rotates in a dragging direction with respect to the rotation of the photosensitive drum 2 in a manner facing the photosensitive drum 2 with a developer carried on the surface thereof; and the casing 3 which has the internal space to accommodate therein the developer and which has the opening along the rotational direction of the developing roller to expose and face a part of the developing roller surface to the photosensitive drum 2 through the opening. In such a developing unit 200, the outer air flows into the internal space of the casing 3 in association with the rotation of the developing roller 1, through the path 115 which is a gap formed between the developing roller surface and the edge of the casing at the downstream side of the opening in the rotational direction of the developing roller. This configuration makes it possible to collect the scattered toner generated in an area around the downstream side of the nip 15 in the rotational direction of the developing roller by the air flow II flowing into the internal space of the casing 3 (the developing unit), in accordance with the rotation of the developing roller 1, through the path 115 formed between the developing roller surface and the edge of the casing 3 at the downstream side of the opening in the rotational direction of the developing roller. Furthermore, in the present embodiment, there is no need to excessively increase the amount of the air flow III. Thereby, the air flow around the developing roller is not disturbed and the excessive toner is not adversely collected into the duct 7 from the upstream suction port 111. Thus, the scattered toner can be surely collected into the duct 7 from the suction ports 111 and 112.

Furthermore, according to the present embodiment, it is possible to present the image forming apparatus capable of reducing the toner scattering or toner pollution, by employing the imaging device provided with the photosensitive drum 2 and the developing unit 200 according to the above-mentioned embodiments, as an image forming unit of the image forming apparatus.

Furthermore, according to the present embodiment, it is possible to present the image forming apparatus capable of reducing the toner scattering or toner pollution, by employing the imaging device provided with the photosensitive drum 2 and the developing unit 200 according to the above-mentioned embodiments, as a process cartridge which serves as an imaging device attachable to and detachable from the image forming apparatus body and which integrally supports the photosensitive drum and the developing unit at least.

Furthermore, according to the present embodiment, it is possible to present the image forming apparatus capable of reducing the toner scattering or toner pollution, by employing the process cartridge which integrally supports the photosensitive drum 2 and the developing unit 200 and which is detachable from and attachable to the image forming apparatus body according to the above-mentioned embodiments, as a process cartridge of the image forming apparatus.

According to the present invention, the width of the air flow path is wider at the downstream side than at the upstream side with respect to the rotational direction of the photosensitive roller (the latent image carrying body). Thus, the air flow expands and flows toward a direction departing from the photosensitive drum surface at the downstream side of the path. This expanded air flow carries and diffuses the scattered toner, which is not collected from the upstream suction port and exists around the photosensitive drum surface, toward the direction departing from the photosensitive drum surface. Thereby, the scattered toner existing on the photosensitive drum surface can be diffused toward the direction departing from the photosensitive drum surface and then drawn or sucked from the downstream suction port, even without arranging the downstream suction port close to the photosensitive drum surface. Therefore, it is possible to prevent the contact between the drum surface and the duct wall surface forming the downstream suction port, which may be caused by the vibration or the like generated during the rotational movement of the photosensitive rollers, in the case that the downstream suction port is arranged close to the drum surface. As a result, it is possible to prevent or reduce the damage of the photosensitive drum surface due to the contact between the drum surface and the duct wall surface.

As described above, the present invention has an excellent advantage of collecting toner scattered in the vicinity of a latent image carrying body surface (photosensitive drum surface) while suppressing scratching or other damage on the latent image carrying body surface.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An imaging device comprising:

a latent image carrying body that is rotatably disposed to carry a latent image;

a developing unit that develops the latent image carried on the latent image carrying body by using a developer containing toner at least;

a duct that is disposed downstream of the developing unit with respect to a rotational direction of the latent image carrying body and that has a wall with an upstream suction port and a downstream suction port formed along the rotational direction of the latent image carrying body; and an air flow generating unit that generates an air flow to be drawn into the duct from the upstream suction port and the downstream suction port, wherein an air flow path is formed in the rotational direction of the latent image carrying body by a surface of the latent image carrying body and a surface of the duct wall, between the upstream suction port and the downstream suction port, and a gap of the air flow path between the surface of the latent image carrying body and the surface of the duct wall is wider at the downstream side of the rotational direction of the latent image carrying body than at the upstream side of the rotational direction of the latent image carrying body.

2. The imaging device according to claim 1, wherein the duct extends longitudinally along an axial direction of the latent image carrying body, and shared by the upstream suction port and the downstream suction port, and an opening width of the upstream suction port is smaller than an opening width of the downstream suction port, when viewed in a section plane perpendicular to the longitudinal direction of the duct.

3. The imaging device according to claim 2, wherein the upstream suction port is closer to the surface of the latent image carrying body, in comparison with the relationship between the downstream suction port and the surface of the latent image carrying body.

4. The imaging device according to claim 1, further comprising a toner tray that is formed at a bottom part of the downstream suction port to receive the toner.

5. The imaging device according to claim 4, wherein an end of the toner tray projects toward the surface of the latent image carrying body with respect to a line when extended from the surface of the duct wall that forms the air flow path.

6. The imaging device according to claim 4, wherein the end of the toner tray projects to a position which is 1 mm to 3 mm away from the surface of the latent image carrying body.

7. The imaging device according to claim 4, wherein at least the end of the toner tray is made of a rubber material.

8. The imaging device according to claim 1, wherein a gap between the upstream suction port and the surface of the latent image carrying body is 1 mm to 3 mm.

9. The imaging device according to claim 1, wherein the developing unit includes a developer carrying body and a casing, the developer carrying body facing to the latent image carrying body and rotating in a direction associated with the rotation of the latent image carrying body while carrying the developer on the surface thereof, and the casing having an internal space for accommodating the developer and an opening for exposing a part of the surface of the developer carrying body in the rotational direction thereof so that the part faces to the latent image carrying body, and an outer air flows into the internal space of the casing in association with the rotation of the developer carrying body through a gap formed between the surface of the developer carrying body and an edge of the opening, the edge located at the downstream side of the rotational direction of the developer carrying body.

10. An image forming apparatus comprising an imaging device, the imaging device including:

a latent image carrying body that is rotatably disposed to carry a latent image;

a developing unit that develops the latent image carried on the latent image carrying body by using a developer containing toner at least;

a duct that is disposed downstream of the developing unit with respect to a rotational direction of the latent image carrying body and that has a wall with an upstream suction port and a downstream suction port formed along the rotational direction of the latent image carrying body; and an air flow generating unit that generates an air flow to be drawn into the duct from the upstream suction port and the downstream suction port, wherein an air flow path is formed in the rotational direction of the latent image carrying body by a surface of the latent image carrying body and a surface of the duct wall, between the upstream suction port and the downstream suction port, and a gap of the air flow path between the surface of the latent image carrying body and the surface of the duct wall is wider at the downstream side of the rotational direction of the latent image carrying body than at the upstream side of the rotational direction of the latent image carrying body.

11. A process cartridge that serves as an imaging device, the imaging device supporting integrally a latent image carrying body and a developing unit at least, and the imaging device attachable to and detachable from an information apparatus body, and the process cartridge comprising:

the latent image carrying body that is rotatably disposed to carry a latent image;

the developing unit that develops the latent image carried on the latent image carrying body by using a developer containing toner at least;

a duct that is disposed downstream of the developing unit with respect to a rotational direction of the latent image carrying body and that has a wall with an upstream suction port and a downstream suction port formed along the rotational direction of the latent image carrying body; and an air flow generating unit that generates an air flow to be drawn into the duct from the upstream suction port and the downstream suction port, wherein an air flow path is formed in the rotational direction of the latent image carrying body by a surface of the latent image carrying body and a surface of the duct wall, between the upstream suction port and the downstream suction port, and a gap of the air flow path between the surface of the latent image carrying body and the surface of the duct wall is wider at the downstream side of the rotational direction of the latent image carrying body than at the upstream side of the rotational direction of the latent image carrying body.

12. The image forming apparatus comprising the process cartridge according to claim 11.

13. An imaging device comprising:

a latent image carrying body that is rotatably disposed to carry a latent image;

a developing unit that develops the latent image carried on the latent image carrying body by using a developer containing toner at least;

a duct that is disposed downstream of the developing unit with respect to a rotational direction of the latent image carrying body and that has an upstream port and a downstream port disposed along the rotational direction of the latent image carrying body; and a duct wall disposed between the upstream port and the downstream port, the duct wall facing a surface of the latent image carrying body, wherein a gap is present between the surface of the latent image carrying body and the surface of the duct wall, and the gap is wider at a downstream side thereof in the rotational direction of the latent image carrying body than at an upstream side thereof in the rotational direction of the latent image carrying body.

14. The imaging device according to claim 13, further comprising an air flow generating unit that generates an air flow to be drawn into the duct from the upstream port and the downstream port.

15. The imaging device according to claim 13, wherein an air flow path is formed in the rotational direction of the latent image carrying body by a surface of the latent image carrying body and a surface of the duct wall, between the upstream port and the downstream port.

16. The imaging device according to claim 13, wherein the duct extends longitudinally along an axial direction of the latent image carrying body, and shared by the upstream port and the downstream port, and an opening width of the upstream port is smaller than an opening width of the downstream port, when viewed in a section plane perpendicular to the longitudinal direction of the duct.

17. The imaging device according to claim 16, wherein the upstream port is closer to the surface of the latent image carrying body, in comparison with the relationship between the downstream port and the surface of the latent image carrying body.

18. The imaging device according to claim 13, further comprising a toner tray formed at a bottom part of the downstream port to receive the toner.

19. The imaging device according to claim 13, wherein a gap between the upstream port and the surface of the latent image carrying body is 1 mm to 3 mm.

* * * * *